US005845568A

United States Patent [19]

Rosser, Jr.

[11] Patent Number: 5,845,568

[45] Date of Patent: Dec. 8, 1998

[54] BAKER WITH HINGED SIDEWALL PRECOMPRESSION

[76] Inventor: F. F. Rosser, Jr., 132 Wanda Rd., Cordele, Ga. 31015

[21] Appl. No.: 731,841

[22] Filed: Oct. 21, 1996

[51] Int. Cl.[6] ..... B30B 9/30

[52] U.S. Cl. ..... 100/190; 100/215; 100/232; 100/233; 100/255

[58] Field of Search ..... 100/35, 190, 215, 100/232, 233, 255, 141

[56] References Cited

U.S. PATENT DOCUMENTS

| | | | |
|---|---|---|---|
| 1,288,656 | 12/1918 | North | 100/141 |
| 1,966,378 | 7/1934 | Dinzl | 100/190 |
| 3,065,586 | 11/1962 | Ghiringhelli | 100/232 |
| 3,479,950 | 11/1969 | Freeman | 100/141 |
| 3,513,768 | 5/1970 | Altmann et al. | 100/233 |
| 3,521,553 | 7/1970 | Smolka et al. | 100/232 |
| 3,693,541 | 9/1972 | Lombard et al. | 100/215 |
| 3,752,059 | 8/1973 | Boyer | 100/215 |
| 4,170,934 | 10/1979 | Oosterling et al. | 100/215 |
| 4,573,403 | 3/1986 | Van Doorn et al. | 100/215 |
| 4,594,942 | 6/1986 | Denneboom | 100/190 |

FOREIGN PATENT DOCUMENTS

| | | | |
|---|---|---|---|
| 2745654 | 10/1978 | Germany | 100/232 |
| 3725733 | 2/1989 | Germany | 100/215 |
| 3926907 | 2/1991 | Germany | 100/215 |
| 5-177393 | 7/1993 | Japan | 100/215 |
| 176910 | 3/1922 | United Kingdom | 100/232 |

*Primary Examiner*—Stephen F. Gerrity
*Attorney, Agent, or Firm*—Hugh D. Jaeger

[57] ABSTRACT

Hinged sidewall member for precompressing waste material in the charging chamber of a horizontal waste baling machine. The hinged sidewall member is located in the charging chamber and has a sidewall and a top cover member extending perpendicularly to the sidewall. The hinged sidewall member is hydraulically operated about a pivot to precharge waste material in the charging chamber prior to compression in an adjacent compression chamber by a reciprocating compression ram.

4 Claims, 9 Drawing Sheets

BAKER WITH HINGED SIDEWALL PRECOMPRESSION

CROSS REFERENCES TO CO-PENDING APPLICATIONS

None.

BACKGROUND OF THE INVENTION

1. Field of the Invention

The present invention is in the field of waste material balers, and more particularly, pertains to baling machines having multiple compression capacity.

2. Description of the Prior Art

Prior art baling machines commonly are of two sizes—narrow charging passage and wide charging passage. The narrow charging passage machines require preprocessing large waste materials, such as large corrugated boxes, by such means as shredding, which in itself is costly. The wide charging passage machines eliminate the need for shredding, but because of their large size, are more expensive, requiring more energy, and are much more costly to operate.

The present invention is intended to be used on balers to bale waste materials. Balers incorporating the invention can bale large bulky waste material without preprocessing, such as shredding, thus eliminating the need for a much larger and more costly baler. A precompression hinged sidewall member permits balers of relatively small size and cost to perform tasks previously requiring much larger and more costly balers. Because of the smaller forces required during baling, energy consumption is considerably less than that of prior art balers.

SUMMARY OF THE INVENTION

The major components of the present invention include, in a baler, a hinged sidewall member located beneath a loading hopper leading to a charging chamber, a main compression ram, and a compression chamber located adjacent to the charging chamber. Waste material is loaded into the loading hopper and then into the charging chamber of the baler. Next, the hinged sidewall member is advanced into the material-laden chamber to precharge or precompress the contained waste material. Precompressed waste material is transferred from the charging chamber into the compression chamber by the main compression ram for further compression and subsequent unloading.

The precompression hinged sidewall member is configured such that the top of the hinged sidewall member forms a cover for the charging chamber when the hinged sidewall member is in the full, actuated position. When the hinged sidewall member is rotated away from the charging chamber, the charging chamber is both uncovered and enlarged horizontally to create a larger charger volume to accept larger quantities of waste material. Also, the single-piece hinged sidewall member precompresses the waste material in addition to preventing the waste material from escaping vertically from the charging chamber when being compressed by the compression ram. The invention can be constructed in various sizes and with various precompression forces. The hinged sidewall member can be constructed with a full cover, a partial cover, or no cover for the charging chamber.

According to one embodiment of the present invention, there is provided a hinged sidewall member resident to a charging chamber. The hinged sidewall member includes a planar sidewall having a pivot at one end and a top cover member aligned perpendicular to the sidewall at the other end. An actuating arm secures to the planar area of the sidewall and extends beyond the sidewall to include an end which attaches to an actuating cylinder. The entire hinged sidewall member is pivoted by action of the actuating cylinder within the charging chamber to compress waste material therein. Both the sidewall and the top cover member compress and precharge the waste material in the charging chamber.

One significant aspect and feature of the present invention is a hinged sidewall member which is hinged and pivoted to precharge waste material in a charging chamber.

Another significant aspect and feature of the present invention is a hinged a sidewall member having side wall and a perpendicular top cover member.

A further significant aspect and feature of the present invention is a top cover member which is crowned to seal against one side of a loading hopper and to provide for structural integrity during charging.

An additional significant aspect and feature of the present invention is the inclusion of a hinged sidewall member which precludes material from escaping through the top region of a charger loading hopper.

Still another significant aspect and feature of the present invention is the ability to assist in the baling of large bulky waste material without costly pre-processing, such as shredding.

Yet another significant aspect and feature of the present invention is the use of the pre-compression hinged sidewall member which permits balers of relatively small size and cost to perform tasks previously requiring much larger and more costly balers. Because of the smaller forces required during baling, energy consumption is considerably less than that of prior art balers.

Having thus described significant aspects and features of the present invention, it is the principal object of the present invention to provide a hinged sidewall member for use in a baler.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
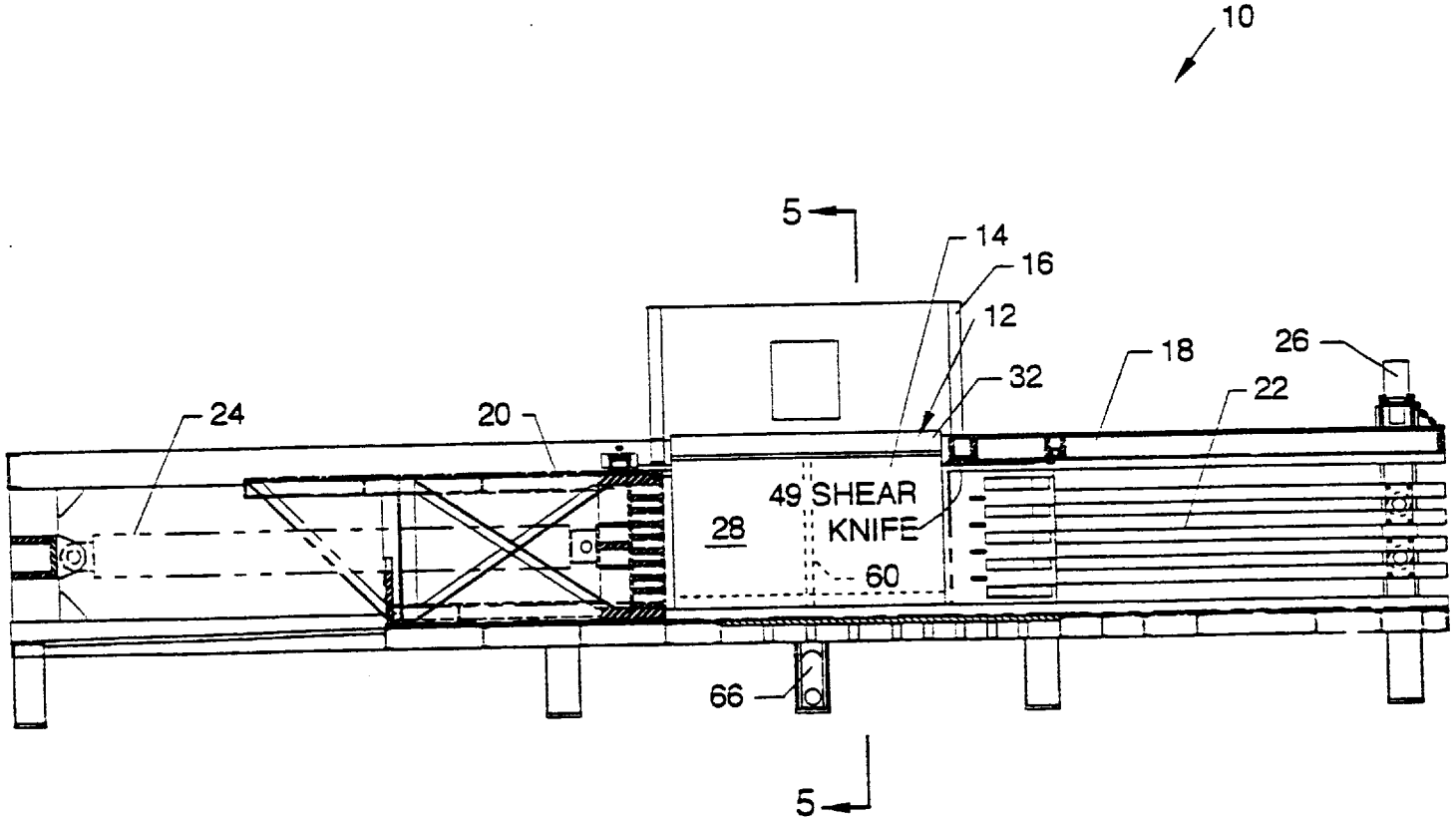
FIG. 1 illustrates a side view in partial cross section of a baler incorporating a hinged sidewall member.
Figure 2:
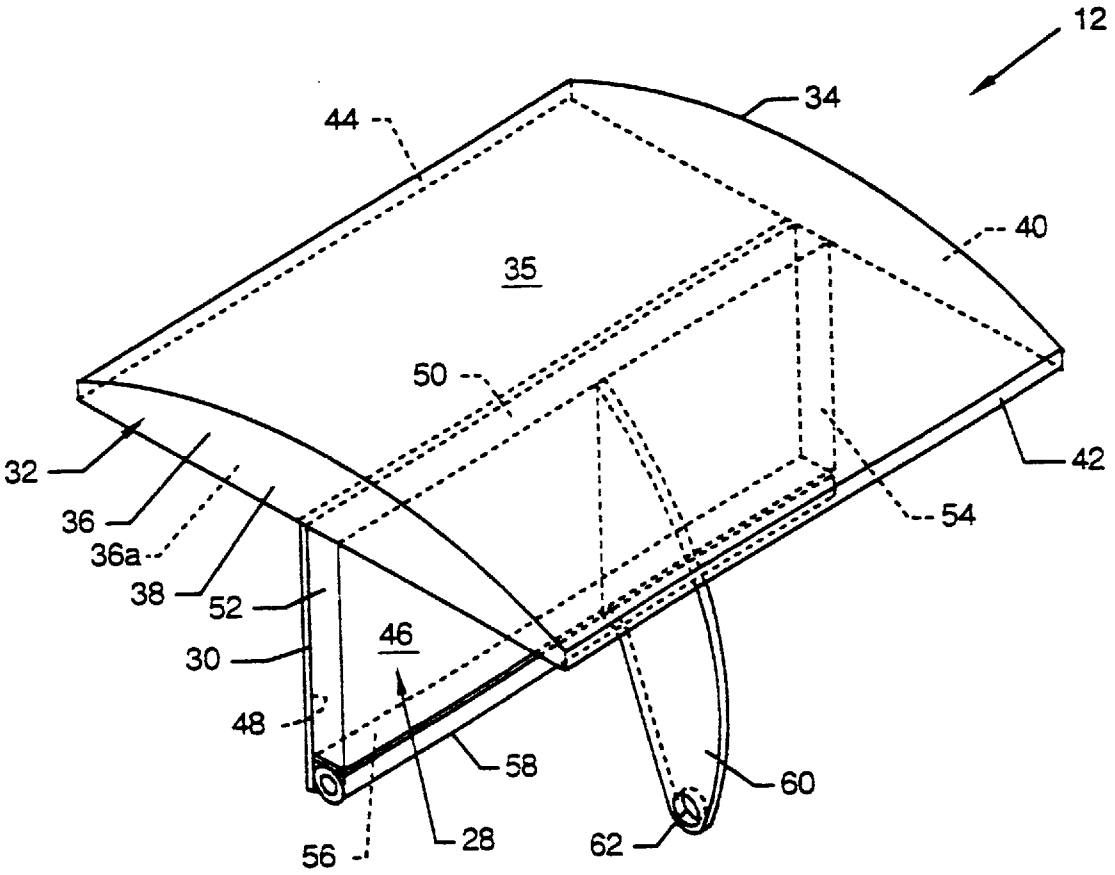
FIG. 2 illustrates an isometric view of the hinged sidewall member.

FIG. 1 illustrates a side view in partial cross section of a baler 10 incorporating a hinged sidewall member 12, illustrated fully in FIG. 2, aligned in a charging chamber 14 and beneath a loading hopper 16. A framework 18 includes a plurality of frame members used to mount and form component members within, without and therethrough. Contained within framework 18 is a main compression ram 20 which is slideably extendable along frame members of the framework 18 and other such suitable members through the charging chamber 14 into a compression chamber 22. A main compression cylinder 24 secures to the framework 18 and is incorporated to power the main compression ram 20. Compression chamber 22 includes a plurality of tension cylinders 26 which adjust the side and top wall members of the variable geometry compression chamber 22 during the compression process. Although tension cylinders 26 are incorporated for chamber control, any other suitable compression chamber configuration can be utilized with the baler 10 and is not to be deemed as limiting the scope of the invention. A shear knife 49 is included at the entrance to the compression chamber 22.

FIG. 2 illustrates an isometric view of the hinged sidewall member 12, where all numerals correspond to those elements previously described. The hinged sidewall member 12 is illustrated in the position and orientation observed when maximum precompression occurs. With respect to the illustrated orientation, the hinged sidewall member 12 includes a vertically oriented sidewall 28 and a vertically oriented planar support and wear plate 30 closely juxtaposed thereto, and both secured perpendicularly to a top cover member 32. The top cover member includes an arcuate crown 34 at its upper surface 35 to provide for a sturdy reinforced central area which will not bend or yield to compressional forces during the precharging process. The crown 34 is radiused, having a cylindrical pivot tube 58 as its vertex, and provides for sealing against a back wall member of the loading hopper 16, as later illustrated. The top cover member 32 also includes a lower planar surface 36, end surfaces 38 and 40 extending between the lower surface 36 and the crown 34, and side surfaces 42 and 44 extending between the lower surface 36 and the crown 34. The sidewall 28 includes a large vertically oriented planar surface 46, an opposing large vertically oriented planar surface 48 upon which support plate 30 is mated, upper surface 50, opposing end surfaces 52 and 54, and a bottom surface 56. A surface section 36a is also designated as the area of the lower planar surface 36 extending between the lower edge of side surface 44 and the upper portion of the sidewall 28 attached to the top cover member 32. Cylindrical pivot tube 58 secures to the bottom sidewall surface 56 and to the portion of the support and wear plate 30 extending beyond the large planar surface 48. An actuating arm 60, including a mounting hole 62, secures to the large planar surface 46 of the sidewall 28 and extends beyond the sidewall 28 as also illustrated in the figures that follow.

Figure 3:
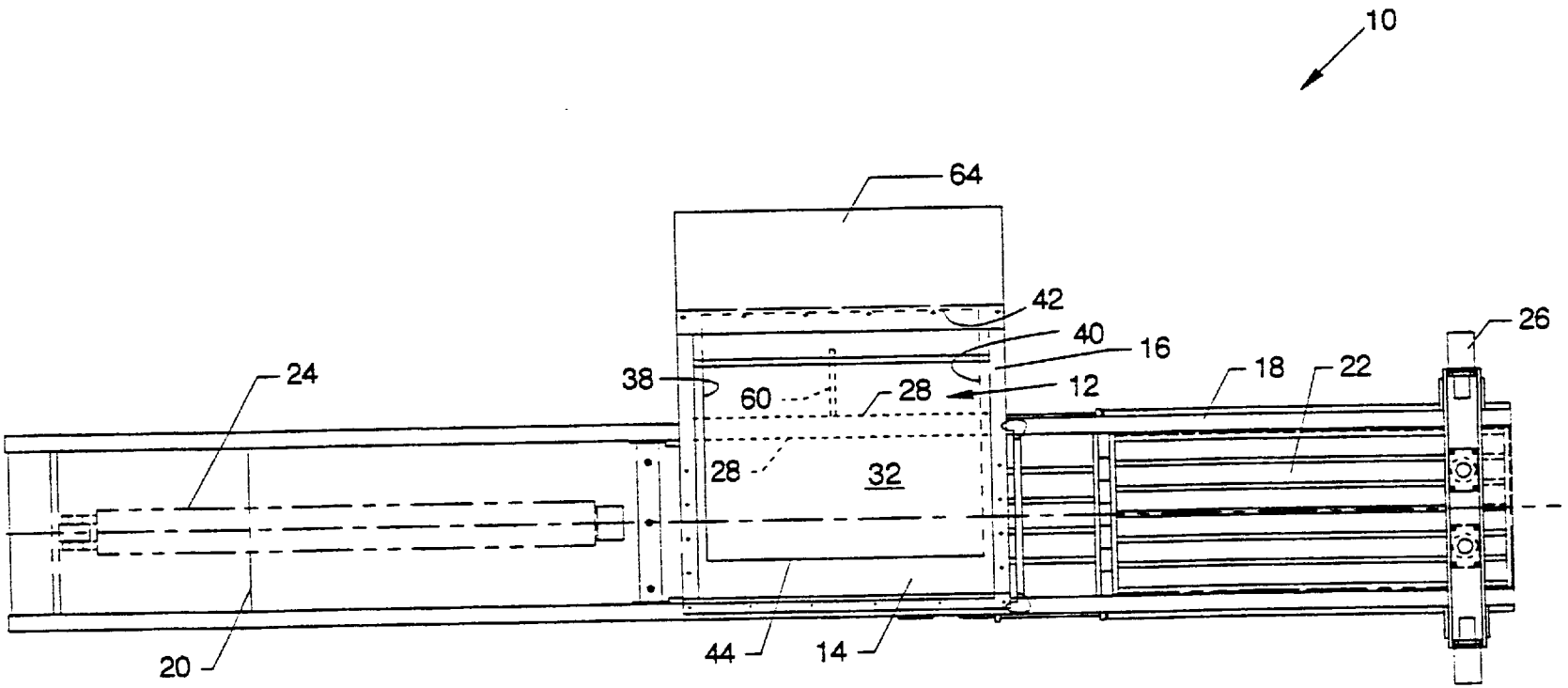
FIG. 3 illustrates a top view of the baler.

FIG. 3 illustrates a top view of the baler 10, where all numerals correspond to those elements previously described.

Figure 4:
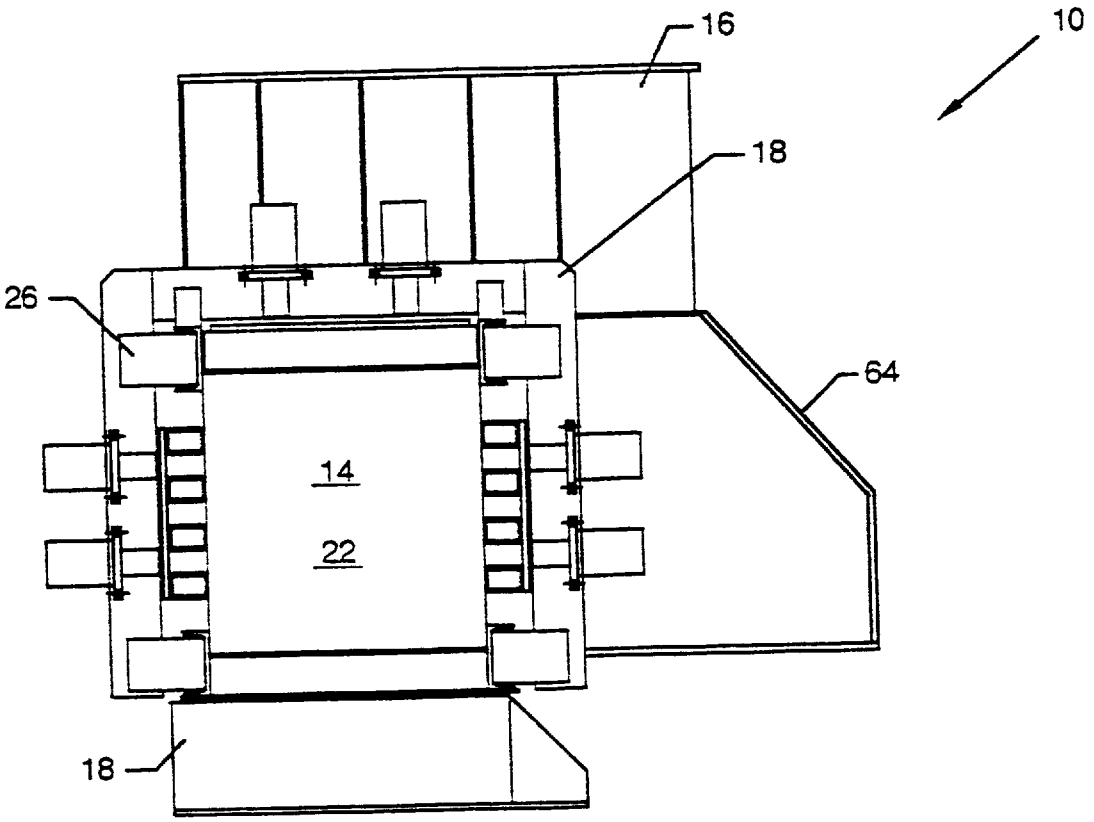
FIG. 4 illustrates an end view of the baler.

FIG. 4 illustrates an end view of the baler 10, where all numerals correspond to those elements previously described. Illustrated in particular is the loading hopper 16 and the housing 64 which extends downwardly from the loading hopper 16 and outwardly from the loading hopper 16 and the framework 18 to accommodate the hinged sidewall member 12, as illustrated in the figures that follow. The hinged sidewall member 12 is not illustrated for purposes of brevity and clarity.

Figure 5:
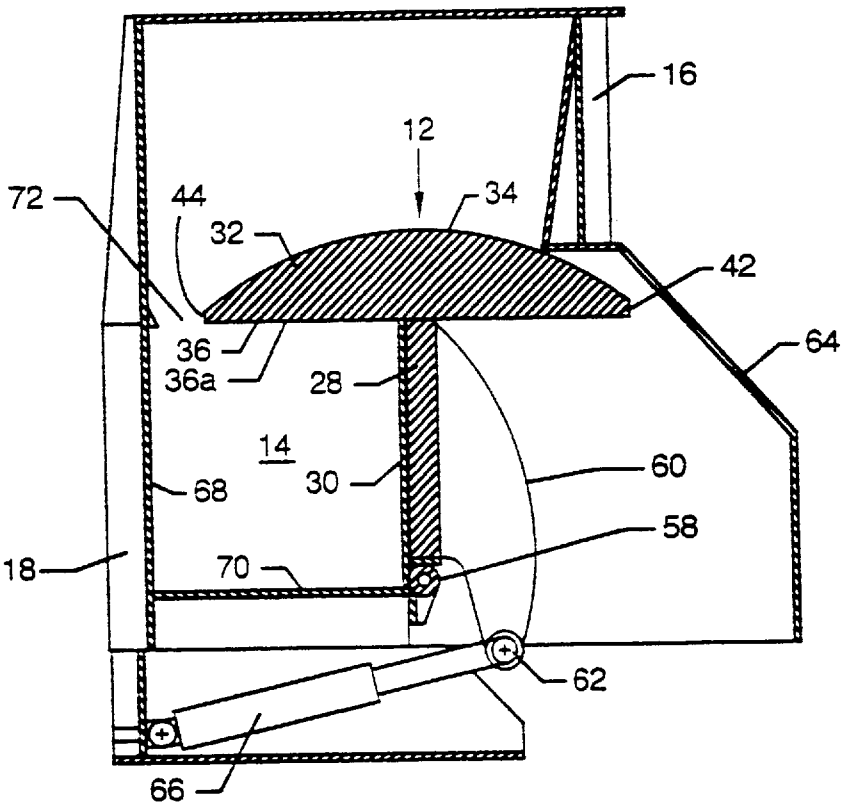
FIG. 5 illustrates an end view of the baler in partial cross section along line 5—5 of FIG. 1.

FIG. 5 illustrates an end view of the baler 10, in partial cross section along line 5—5 of FIG. 1, where all numerals correspond to those elements previously described. The hinged sidewall member 12 is illustrated in the maximum precharging position where the sidewall 28 is vertically oriented and the top cover member 32 is oriented horizontally to form two sides of the charging chamber 14. Fixed planar sidewall members 68 and 70 form the remaining sides of the charging chamber 14. This orientation is also the same orientation required for filling of the loading hopper 16, as later described in detail. A linear actuator 66, in the form of a hydraulic cylinder, secures at one end to the framework 18. The opposing end of the linear actuator 66 secures appropriately to hole 62 at the lower end of the actuating arm 60. The linear actuator 66 is illustrated in the fully extended position to pivot the hinged sidewall member 12 about the cylindrical pivot tube 58 which is pivotally secured to the framework 18.

Figure 6:
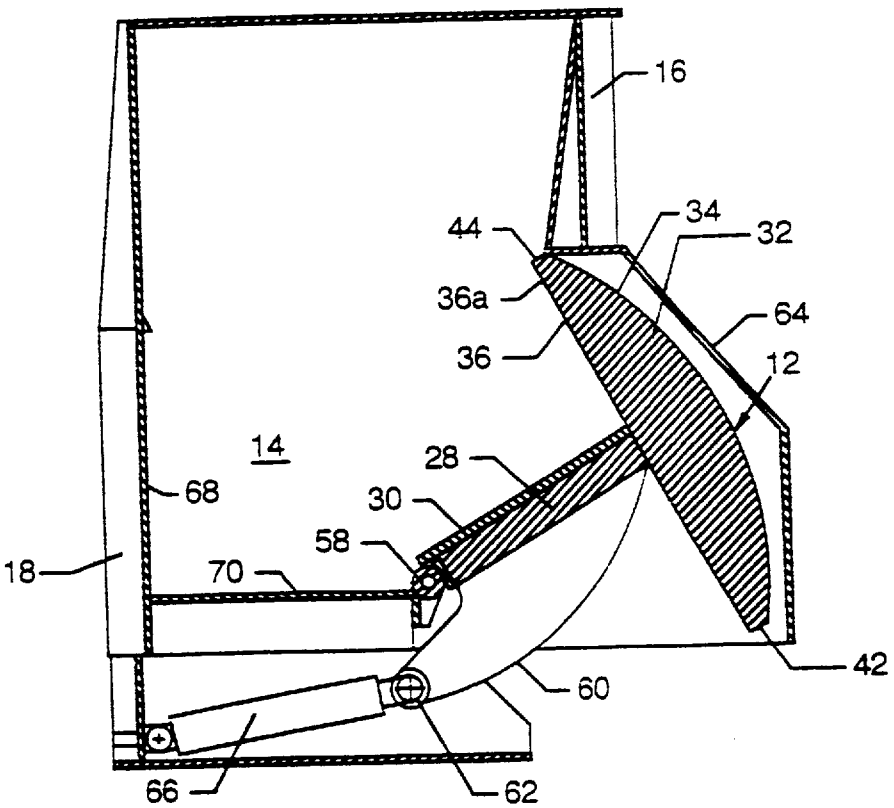
FIG. 6 illustrates the view of FIG. 5 with the hinged sidewall member in the loading position where the sidewall and top cover member are oriented at an oblique angle to the loading hopper and charging chamber.

FIG. 6 illustrates the view of FIG. 5, where all numerals correspond to those elements previously described. The hinged sidewall member 12 is illustrated in the loading position where the sidewall 28 is oriented at an oblique angle and the top cover member 32 is likewise oriented in an oblique fashion to allow material into the charging chamber 14. This orientation is also the same orientation required for filling of material from the loading hopper 16 into the charging chamber 14, as later described in detail. The linear actuator 66 is illustrated in the retracted position to pivot the hinged sidewall member 12 about the cylindrical pivot tube 58, thus pivoting the hinged sidewall member 12 to the oblique position.

Mode of Operation

Figure 7:
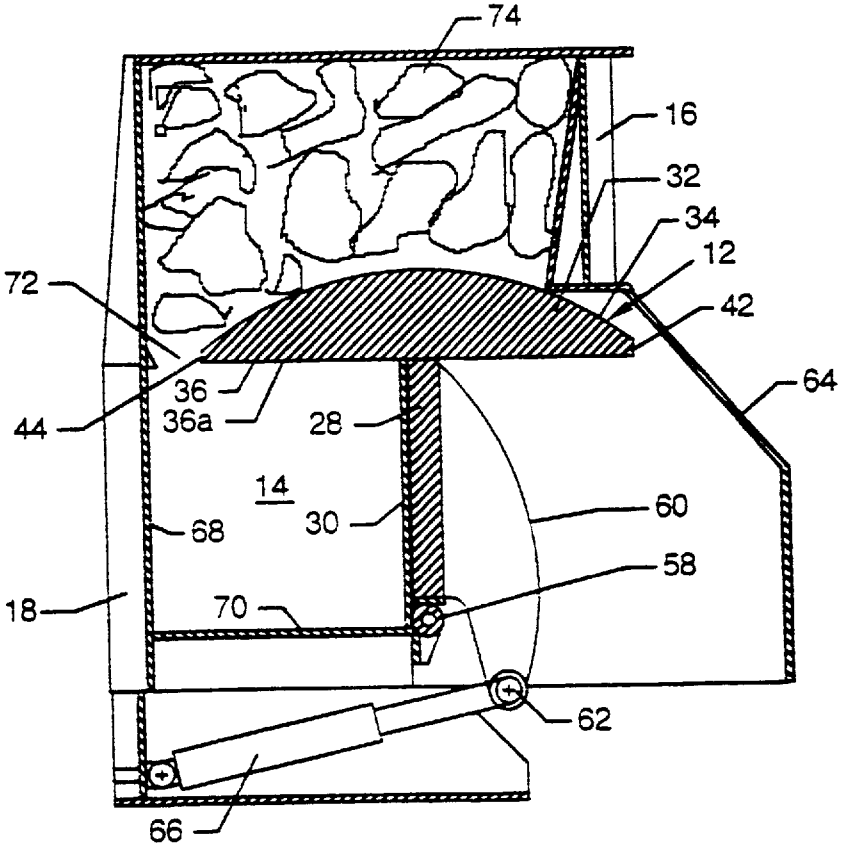
FIG. 7 illustrates the view of FIG. 5 with waste material in the loading hopper.
Figure 8:
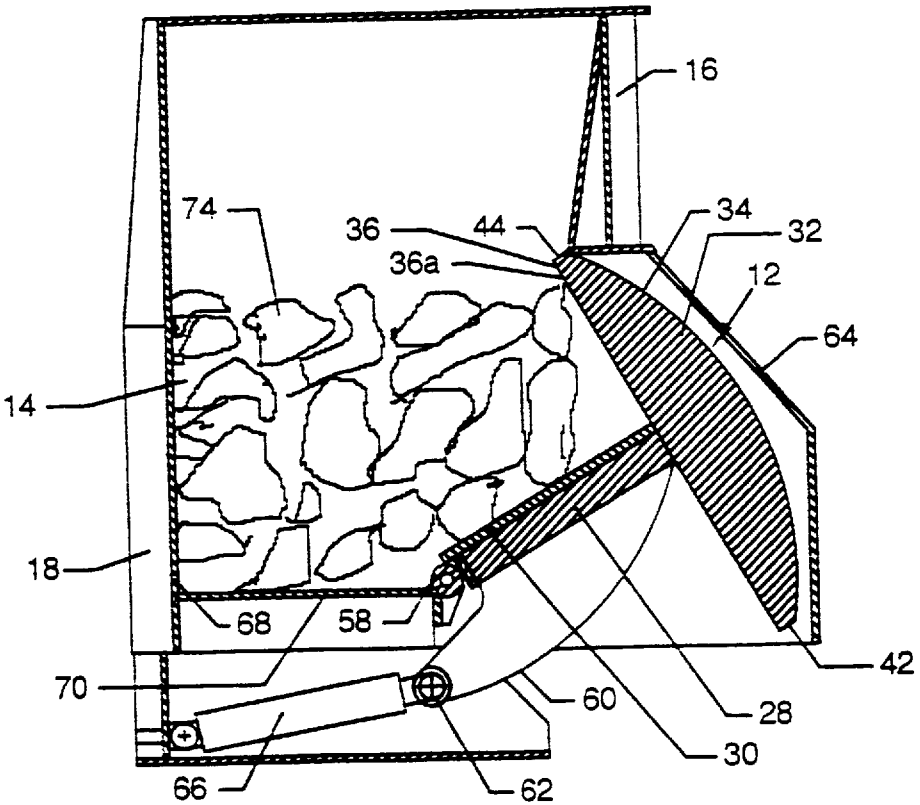
FIG. 8 illustrates the view of FIG. 6 with waste material in the charging chamber; and, FIG. 9 illustrates the view of FIG. 5 with precharging of waste material in the charging chamber.
Figure 9:
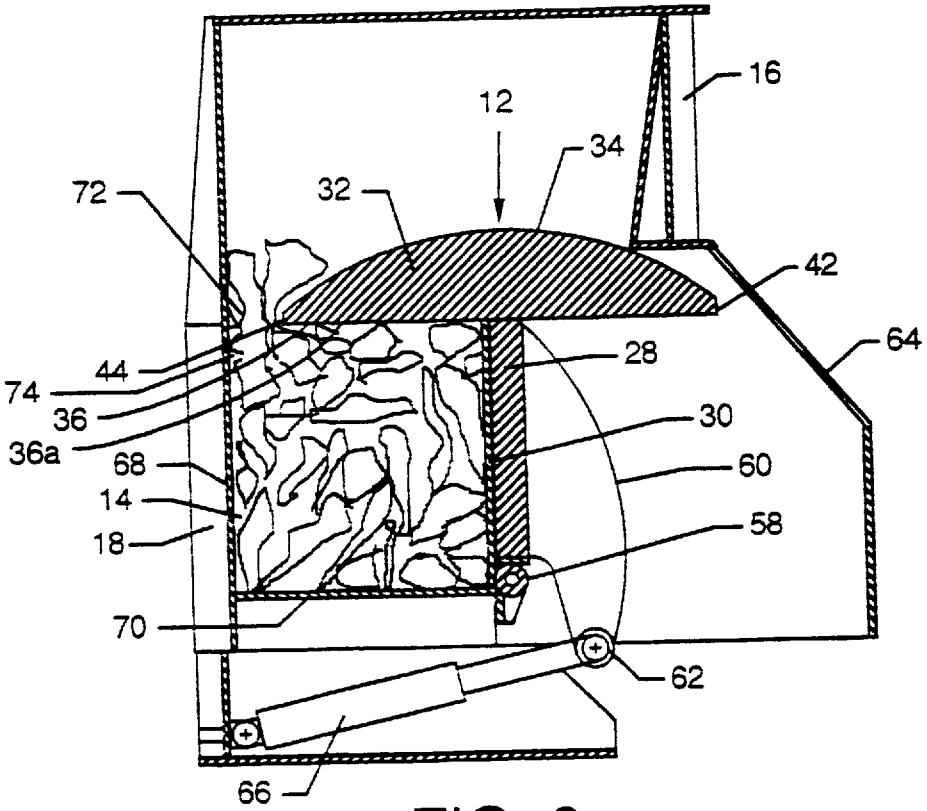

FIGS. 7, 8 and 9 best illustrate the mode of operation of the hinged sidewall member 12 and include showings of component members complementing the operation of the baler 10, where all numerals correspond to those elements previously described.

FIG. 7 illustrates the receiving of waste material 74 into the loading hopper 16.

FIG. 8 illustrates the receiving of waste material 74 into the charging chamber 14.

FIG. 9 illustrates the precharging of waste material 74 in the charging chamber 14.

With reference to FIGS. 7, 8 and 9, as well as other FIGS., the mode of operation is described. The baler 10 is ready for loading when the hinged sidewall member 12 is closed, as in FIG. 7, and the main compression ram 20 is retracted, as in FIG. 1. Waste material 74 is loaded into the loading hopper 16 until the loading hopper 16 is filled to the correct level. The hinged sidewall member 12 then is opened by the linear actuator 66. As the hinged sidewall member 12 is rotatably opened, as illustrated in FIG. 8, the waste material 74 falls into the charging chamber 14. When the waste material 74 has fallen into the charging chamber 14, the hinged sidewall member 12 is closed by linear actuator 66. As shown in FIG. 7, the top cover member 32 of the hinged sidewall member 12 is constructed such that in the closed position it does not totally close the top portion of the charging chamber 14. The parts are dimensioned such that a space 72 is created between the side surface 44 of the top cover member 32 and the fixed planar sidewall member 68. This is to allow a space 72 for any waste material 74 which is not forced totally into the charging chamber 14. This space 72 prevents any overage of material 74 which is not compressed into the charging chamber 14 from impeding the hinged sidewall member 12 from moving to its proper fully closed position, as illustrated in FIG. 9. When the hinged sidewall member 12 is closed, the main compression ram 20 is moved forward by main compression cylinder 24. The main compression ram 20 moves the waste material 74 forward into the compression chamber 22. Any waste material 74 which is trapped in the space 72 between the side surface 44 of the hinged sidewall member 12 and the fixed sidewall member 68 is sheared off by the shear knife 49, of FIG. 1, which is located at the entrance to the compression chamber 22. The shearing action occurs when the main compression ram 20 passes under the shear knife 49. The main compression ram 20 continues forward applying its force to the waste material 74 until it reaches a predetermined position in the compression chamber 22. The main compression ram 20 then retracts and the sequence is repeated until the waste material 74 is compressed into the desired bale density. Once the desired bale density is achieved, the main compression ram 20 is positioned to a predetermined location and some form of containment device, such as wire or straps, is wrapped around the bale to maintain the bale density when the bale is ejected from the compression chamber 22. After the bale is wrapped with the containment device, the bale is pushed out of the compression chamber 22, either by the main compression ram 20 or by the next bale as it is being compressed by the main compression ram 20. The baler 10 used to explain the operation of the hinged sidewall member 12 is a single ram horizontal baler using tension cylinders 26 to restrict the waste material as it is being compressed. The hinged sidewall member 12 can be utilized on many different types of balers, such as multiple ram, closed door single ram, and side eject.

Various modifications can be made to the present invention without departing from the apparent scope hereof.

I claim:

1. A baler for compressing waste material into a bale comprising:

a. a main compression cylinder which drives a main compression ram;

b. a charging hopper into which said waste material to be compressed is loaded;

c. a charging chamber connected to said hopper for receiving waste material from said hopper and for precompressing said waste material comprising:

(1) a first fixed side planar member;

(2) a bottom fixed planar member;

(3) a hinged sidewall with a covered top member aligned perpendicular to said hinged sidewall, said hinged sidewall pivotally connected to said bottom planar member forming a second side to said charging chamber and a top to said charging chamber when positioned in a closed position to precompress waste material contained in said charging chamber and forming an opening to said hopper when positioned in an open position;

d. a linear actuator attached to said first fixed side member and to said hinged sidewall for pivoting said hinged sidewall between said opened and closed positions; and, e. a compression chamber connected to said charging chamber to receive said waste material precompressed in said charging chamber and discharged along a horizontal line from said charging chamber by said main compression ram.

2. The device of claim 1, wherein said covered top member is an arcuate crown to form a seal a side of said charging hopper.

3. The device of claim 1, wherein the compression chamber includes sidewall members and a top wall member, and tension cylinders positioned around said compression chamber to adjust the sidewall and top wall members of said compression chamber to restrict the waste material as it is being compressed.

4. The device of claim 1, wherein said hinged sidewall pivots on an axis which is parallel to said line of horizontal discharge of said precompressed waste material.

* * * * *

UNITED STATES PATENT AND TRADEMARK OFFICE

CERTIFICATE OF CORRECTION

PATENT NO. : 5,845,568
DATED : December 8, 1998
INVENTOR(S) : F. F. Rosser, Jr.

It is certified that error appears in the above-identified patent and that said Letters Patent is hereby corrected as shown below:

On the title page, item [54] and column 1, line 1 "Baker" should read --Baler--.

Signed and Sealed this

Twenty-second Day of August, 2000

*Attest:*

Q. TODD DICKINSON

*Attesting Officer*

*Director of Patents and Trademarks*